US009347279B2

(12) United States Patent
Crowley et al.

(10) Patent No.: US 9,347,279 B2
(45) Date of Patent: May 24, 2016

(54) TORQUE CONTROL DEVICE FOR A DOWNHOLE DRILLING ASSEMBLY

(71) Applicant: Smart Stabilizer Systems Limited, Ashchurch, Tewkesbury (GB)

(72) Inventors: Daniel Brendan Crowley, Gloucester (GB); Colin Walker, Tideswell (GB)

(73) Assignee: SMART STABILIZER SYSTEMS LIMITED, Ashchurch, Tewkesbury (GB)

( * ) Notice: Subject to any disclaimer, the term of this patent is extended or adjusted under 35 U.S.C. 154(b) by 198 days.

(21) Appl. No.: 13/776,185

(22) Filed: Feb. 25, 2013

(65) Prior Publication Data

US 2013/0220701 A1 Aug. 29, 2013

(30) Foreign Application Priority Data

Feb. 28, 2012 (GB) ..... 1203433.6
Jun. 26, 2012 (GB) ..... 1211300.7

(51) Int. Cl.

| | |
|---|---|
| ***E21B 17/07*** | (2006.01) |
| ***E21B 44/04*** | (2006.01) |
| ***E21B 44/06*** | (2006.01) |
| ***E21B 47/00*** | (2012.01) |
| ***E21B 44/00*** | (2006.01) |

(52) U.S. Cl.

CPC ..... *E21B 17/073* (2013.01); *E21B 17/076* (2013.01); *E21B 44/005* (2013.01); *E21B 44/04* (2013.01); *E21B 47/00* (2013.01); *E21B 44/06* (2013.01)

(58) Field of Classification Search

CPC ..... E21B 17/07; E21B 17/073; E21B 17/076; E21B 4/18; E21B 44/06; E21B 44/04

See application file for complete search history.

(56) References Cited

U.S. PATENT DOCUMENTS

| | | | |
|---|---|---|---|
| 1,414,207 | A | 4/1922 | Heed |
| 1,518,634 | A | 12/1924 | Cason, Jr. |
| 1,610,414 | A | 12/1926 | Bernard |
| 1,708,378 | A | 4/1929 | Dale |
| 1,839,690 | A | 1/1932 | Malinowski |
| 1,923,132 | A | 8/1933 | Watkin |

(Continued)

FOREIGN PATENT DOCUMENTS

| | | | |
|---|---|---|---|
| EP | 1024245 | A2 | 8/2000 |
| WO | 2004090278 | A1 | 10/2004 |

OTHER PUBLICATIONS

Search Report for Great Britain Application No. GB1302453.4 dated Jun. 6, 2013, 1 page.

*Primary Examiner* — Giovanna C Wright
(74) *Attorney, Agent, or Firm* — Blank Rome, LLP

(57) ABSTRACT

This invention relates to a torque control device for a downhole drilling assembly. The torque control device is adapted for connection to a drill bit, and has an outer sleeve and an inner shaft, the outer sleeve being movable longitudinally relative to the inner shaft. The torque control device also has a cylinder, a piston located within the cylinder, and a controller to control the volume of the cylinder. Changing the volume of the cylinder causes relative longitudinal movement between the outer sleeve and the inner shaft. The controller can receive inputs from a torque sensor and/or an accelerometer in order to determine if a threshold torque has been exceeded. Alternatively the controller can comprise a rotary valve which automatically responds to torque in the assembly.

21 Claims, 3 Drawing Sheets

(56) References Cited

U.S. PATENT DOCUMENTS

| | | | | |
|---|---|---|---|---|
| 2,422,223 | A | 6/1947 | Church | |
| 2,500,276 | A | 3/1950 | Church | |
| 3,503,224 | A | 3/1970 | Davidescu | |
| 3,727,948 | A | 4/1973 | Current | |
| 3,939,670 | A | 2/1976 | Amtsberg | |
| 3,978,930 | A * | 9/1976 | Schroeder | 175/94 |
| 4,064,953 | A | 12/1977 | Collins | |
| 4,139,994 | A | 2/1979 | Alther | |
| 4,162,619 | A | 7/1979 | Nixon, Jr. | |
| 4,655,479 | A | 4/1987 | Farr, Jr. | |
| 4,772,245 | A | 9/1988 | Readman | |
| 4,901,806 | A | 2/1990 | Forrest | |
| 5,137,087 | A | 8/1992 | Crump | |
| 5,323,852 | A | 6/1994 | Bethel | |
| 5,372,548 | A | 12/1994 | Wohlfeld | |
| 5,588,916 | A | 12/1996 | Moore | |
| 5,772,514 | A | 6/1998 | Moore | |
| 5,947,214 | A | 9/1999 | Tibbitts | |
| 6,182,774 | B1 | 2/2001 | Tibbits | |
| 6,308,940 | B1 | 10/2001 | Anderson | |
| 6,325,163 | B2 | 12/2001 | Tibbitts | |
| 6,357,538 | B2 | 3/2002 | Tibbitts | |
| 6,497,295 | B1 | 12/2002 | Carmichael | |
| 6,530,429 | B2 | 3/2003 | Howlett | |
| 6,543,556 | B1 | 4/2003 | Anderson | |
| 6,594,881 | B2 | 7/2003 | Tibbitts | |
| 6,607,043 | B1 | 8/2003 | Sunde | |
| 6,681,949 | B2 | 1/2004 | Tibor | |
| 6,808,455 | B1 | 10/2004 | Solorenko | |
| 6,834,889 | B2 | 12/2004 | Sunde | |
| 6,892,812 | B2 | 5/2005 | Niedermayr et al. | |
| 6,997,271 | B2 | 2/2006 | Nichols | |
| 7,025,151 | B2 | 4/2006 | Hehli | |
| 7,044,240 | B2 | 5/2006 | McNeilly | |
| 7,377,337 | B2 | 5/2008 | Down | |
| 7,438,140 | B2 | 10/2008 | Sterling | |
| 7,578,360 | B2 | 8/2009 | Haughom | |
| 7,610,970 | B2 | 11/2009 | Shepherd | |
| 7,654,344 | B2 | 2/2010 | Haughom et al. | |
| 7,779,932 | B2 | 8/2010 | Hartung | |
| 2001/0045300 | A1 * | 11/2001 | Fincher et al. | 175/26 |
| 2008/0264689 | A1 * | 10/2008 | Blount et al. | 175/25 |
| 2009/0173591 | A1 | 7/2009 | Nagayama | |
| 2009/0277687 | A1 * | 11/2009 | Lee | 175/57 |
| 2010/0184519 | A1 | 7/2010 | Nagayama | |
| 2011/0198126 | A1 | 8/2011 | McLoughlin | |
| 2011/0240313 | A1 | 10/2011 | Knobloch, Jr. | |

* cited by examiner

TORQUE CONTROL DEVICE FOR A DOWNHOLE DRILLING ASSEMBLY

CROSS-REFERENCE TO RELATED APPLICATIONS

This application claims priority to United Kingdom Patent Application No. GB1203433.6 filed on Feb. 28, 2012, and United Kingdom Patent Application No. GB1211300.7 filed on Jun. 26, 2012, the contents of each one incorporated herein by reference.

FIELD OF THE INVENTION

This invention relates to a torque control device for a downhole drilling assembly.

BACKGROUND OF THE INVENTION

When drilling for oil and gas, the downhole drill bit is connected to surface equipment by way of a drill string. The drill string is hollow whereby drilling fluid or mud can be pumped down the borehole, the mud acting to lubricate the drill bit and to carry drill cuttings back to the surface. The mud and entrained drill cuttings return to the surface along the outside of the drill string, the drill string being smaller than the diameter of the borehole.

In some drilling applications the drill string is rotated at the surface, with the rotation being communicated to the drill bit by the drill string. In other drilling applications a downhole motor such as a mud motor is provided, which uses the flowing mud to drive the drill bit to rotate. A downhole motor may be used with a rotating, or a non-rotating, drill string.

The surface equipment applies a downhole force upon the drill string, which force is communicated to the drill bit. In addition to the torque seeking to rotate the drill bit there is also a force acting to advance the bit into the rock at the leading end of the borehole, the latter force typically being referred to as "weight on bit".

The drill operator will typically seek to maximise the weight on bit so that the drill advances as quickly as possible through the rock. However, there is a maximum limit for the weight on bit which depends upon the bit design and the drilling conditions. Exceeding the maximum weight on bit for the particular bit design and drilling conditions will increase the drag upon the drill bit and cause the drill bit to slow down or stall, i.e. the drill bit will rotate more slowly, or in extreme cases stop rotating altogether.

If the drill bit does rotate more slowly than the drill string, or than the output of the downhole motor, then the drill string will be caused to twist as torque output from the surface equipment (or downhole motor) increases in response to maintain the original rate of rotation. Eventually, torque at the drill bit will exceed the resistance to rotation and the drill bit will start to rotate again.

Such a phenomenon is known as "stick-slip" and is a major concern to drill operators. Firstly, the drill string may be damaged by the requirement to twist as the drill bit slows down or stops. Secondly, the drill bit will often rotate very rapidly, and uncontrolledly, as the torque in the twisted drill string is relieved. Periods of slow or non-rotation of the drill bit followed by rapid and uncontrolled rotation of the drill bit will often be repeated if they are not countered.

Drill operators seek to avoid stick-slip by reacting to reductions in the rate of rotation of the drill bit by reducing the weight on bit, so that the drill bit resumes its desired rate of rotation quickly without undue twisting of the drill string. A reduction in the rate of rotation of the drill bit can be detected directly by measuring the rate of rotation of the drill bit, or (more typically) by measuring the torque being applied to the drill bit, the torque increasing as the rate of rotation reduces.

The prior art includes torque control devices which can automatically reduce the weight on bit if the torque upon the drill bit exceeds a certain threshold. One prior art arrangement is described in WO 2004/090278 (Tomax). This document has an outer sleeve connected to the drill string and an inner shaft connected to the drill bit. The outer sleeve and the inner shaft are interconnected by a helical thread. A spring biases the inner shaft outwardly of the outer sleeve, into engagement with a fixed stop upon the outer sleeve. During normal drilling operations the inner shaft is driven to rotate by the sleeve, and in turn drives the drill bit to rotate at the same rate as the drill string. If the drill bit slows down or stops, however, the torque upon the drill bit increases sufficiently to drive the sleeve to rotate relative to the shaft, compressing the spring. The helical thread between the inner shaft and the outer sleeve means that rotation of the inner shaft relative to the outer sleeve causes the inner shaft to retract into the sleeve, thereby retracting the drill bit and reducing the weight on bit. As the weight on bit is reduced a point is reached where the drill bit can resume its rotation. The spring causes the inner sleeve to return to its extended position in engagement with the fixed stop, during which the drill bit rotates faster than the drill string.

The Tomax arrangement can include an oil damper, i.e. the spring and cooperating helical threaded components can lie within an oil reservoir which damps out the movement of the inner shaft relative to the outer sleeve, preventing uncontrolled rotation of the inner sleeve and therefore the drill bit.

A similar arrangement is described in U.S. Pat. No. 7,044,240 (McNeilly), and also in Tomax's later U.S. Pat. No. 7,654,344, which uses a helical spring rather than a helical thread to interconnect the outer sleeve and the inner shaft.

The prior art arrangements all rely upon compression springs, and it will be understood that the force provided by those springs must exceed the weight on bit. The design of the tools must therefore include a calculation for the maximum weight on bit which can be catered for, and once the spring rate has been determined it cannot be adjusted. When drilling for oil and gas, however, the rock type through which the drill must pass can vary significantly during a drilling operation, and if the spring force is set too low the tool may reduce the drilling torque even if the drill is not sticking, i.e. the drill operator cannot exceed the weight on bit determined by the spring force, even if the drilling conditions are more favourable than expected and the drill bit would not stick with a greater weight on bit. If, on the other hand, the spring force is set too high for the particular drilling conditions, the drill bit may undergo significant stick-slip without actuation of the torque control device.

SUMMARY OF THE INVENTION

The inventor has realised that an improved device is required for reducing the weight on bit and thereby reducing the torque upon a drill bit whereby to reduce or avoid the likelihood of stick-slip. One object of the invention is to provide a device which enables the torque at which the weight on bit is reduced to be adjusted downhole to match the drilling conditions.

According to the invention there is provided a torque control device for a downhole drilling assembly, the torque control device being adapted for connection to a drill bit, the torque control device including an outer sleeve and an inner shaft, the inner shaft being movable longitudinally relative to the outer sleeve, the inner shaft having a through-bore for carrying drilling fluid to the drill bit, the device having a piston and cylinder arrangement and a controller which controls the volume of the cylinder.

It is arranged that the relative position of the inner shaft relative to the outer sleeve (in the direction of the longitudinal axis of the torque control device) is determined by the volume of the cylinder, so that the controller controls the (longitudinal) movement of the inner shaft relative to the outer sleeve. The controller preferably has a memory in which is stored a threshold value, the controller causing the inner shaft to move relative to the outer sleeve when the threshold value is reached or exceeded. The controller can desirably be adjusted (preferably downhole) whereby the threshold value can be adjusted to match the drilling conditions.

The controller can be connected to a torque sensor adapted to measure the torque in a part of the downhole assembly, suitably the torque in a part of the downhole assembly connected to the drill bit. Alternatively, the controller can be connected to a sensor such as an accelerometer which measures the rate of rotation of the drill bit (or a part of the downhole assembly connected to the drill bit) whereby to detect reductions in the rate of rotation of the drill bit. The controller can in some embodiments receive and compare the inputs from two accelerometers, one accelerometer located close to the drill bit and the other accelerometer located remote from the drill bit. Sticking of the drill bit can be detected by changes in the relative outputs of the two accelerometers.

Preferably the inner shaft is connected to the drill string and the outer sleeve is connected to the drill bit, but it will be understood that the orientation of these components can be reversed without departing from the invention.

Desirably, the cylinder is connected to the through-bore whereby the cylinder will be filled with drilling fluid in use. The drilling fluid can therefore provide the hydraulic fluid for the piston and cylinder arrangement. In such an arrangement, the cylinder can also be open to the periphery of the downhole assembly, so that in use drilling fluid can flow out of the cylinder into the annulus surrounding the downhole assembly, and along which the drilling fluid returns to the surface. Such arrangements take advantage of the pressure differential which occurs between the drilling fluid within the through-bore (i.e. upstream of the drill bit) and in the annulus (i.e. downstream of the drill bit).

Preferably, the controller controls the position of an actuating valve whereby to control the flow of drilling fluid into the cylinder. It can be arranged that the port from the through-bore into the cylinder is of larger cross-section than the port in the periphery of the downhole assembly. This arrangement avoids the requirement for a separate actuating valve controlling the egress of drilling fluid from the cylinder, it being arranged that the larger entry port will act to increase the volume of the cylinder when the actuating valve is opened, and the (always open) exit port will allow the drilling fluid to drain out of the cylinder, so as to reduce the volume of the cylinder, when the actuating valve is closed.

Desirably, a return spring is provided to bias the piston so as to reduce the volume of the cylinder. It is arranged that when the actuating valve is closed the biasing force of the return spring is sufficient to force drilling fluid out of the cylinder and into the surrounding annulus so as to reduce the volume of the cylinder and drive the inner shaft to move longitudinally relative to the outer sleeve.

In certain embodiments the threshold value of the controller can be adjusted during use. It is known to communicate from the surface to a downhole tool, and it is also know to communicate by way of the drilling fluid. In the "RipTide" drilling reamer of Weatherford, Inc. radio frequency identification (RFID) units are injected into the drilling fluid and sent downhole with the fluid. As the RFID units pass a controller of the reamer they are read and used to adjust the status of the reamer. A similar system can be used with the present invention, with the controller being adapted to react to messages sent downhole, for example by way of RFID units, whereby the threshold value for actuation of the device can be adjusted during use. It is therefore not necessary to trip the downhole assembly in order to adjust the threshold value, and if the drilling conditions become more (or less) favourable and a greater (or lesser) weight on bit can be accommodated without incurring stick-slip, the threshold value can be increased (or decreased) accordingly.

Certain embodiments of the present invention can avoid the requirement for sensors communicating torque and/or acceleration to the controller. In such embodiments the controller is in the form of a rotary valve, and admission of drilling fluid into the cylinder is controlled by the rotary valve which automatically moves to an open position (or to a more open position) when the torque within the downhole assembly exceeds a predetermined threshold.

Whilst in the simplest embodiments of the present invention the drilling fluid is caused to flow into and out of the cylinder in order to determine the volume of the cylinder, in other embodiments a closed hydraulic system is used. In those other embodiments the volume of the cylinder, and therefore the position of the inner shaft relative to the outer sleeve, is determined by a hydraulic fluid which is isolated from, and independent of, the drilling fluid. Such alternative embodiments are more mechanically complex, but avoid the possible problems associated with the use of drilling fluid as the hydraulic fluid. The electrical and hydraulic power for a closed hydraulic system can be provided by a downhole pump in known fashion.

The inventors have also realised that the device of the present invention can be used for other downhole applications where the torque transmitted to the drill bit requires adjustment. One such application is in drilling applications using an under-reamer for example. An under-reamer, such as the aforementioned "RipTide" drilling reamer of Weatherford, Inc., uses a reamer as well as a drill bit, the reamer following the drill bit and reaming out a larger diameter borehole along chosen lengths of the borehole. It is advantageous to balance the drilling torque provided by the drill string between the drill bit and the reamer so as to maximise the rate of advance of the downhole assembly. The present invention can be located in the downhole assembly between the reamer and the drill bit and can control the torque transmitted to the drill bit and thereby control the proportion of the drilling torque utilised by the drill bit and that used by the reamer.

BRIEF DESCRIPTION OF THE PREFERRED EMBODIMENTS

The invention will now be described in more detail, by way of example, with reference to the accompanying schematic drawings, in which.

DETAILED DESCRIPTION

Figure 1:
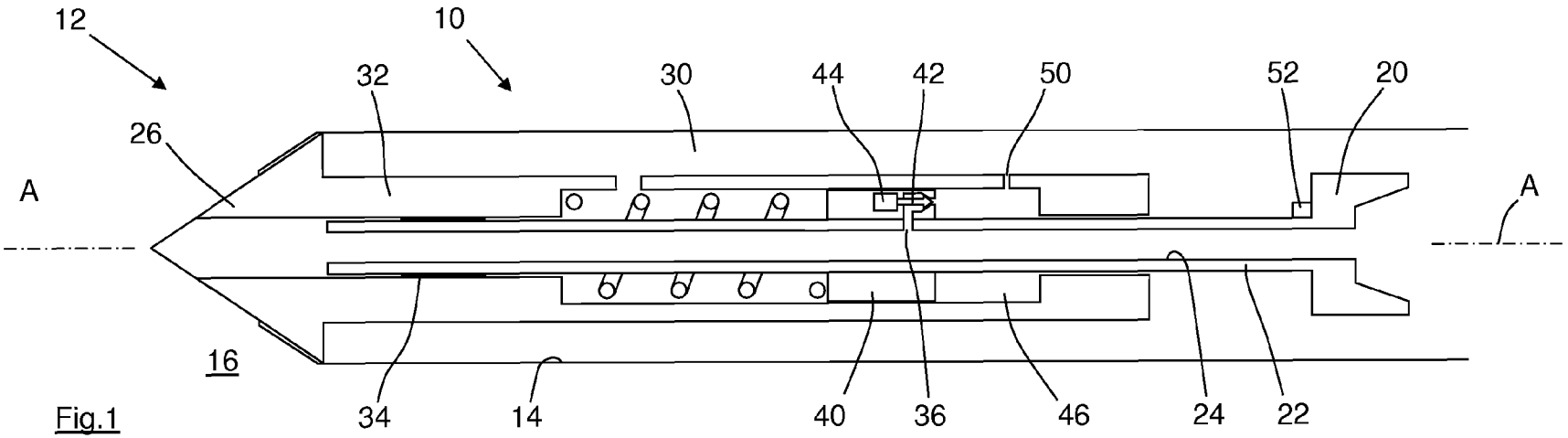
FIG. 1 shows a side view of a tool according to the present invention, in a normal, non-actuated, condition of use.

The torque control device 10 of the present invention is part of a downhole assembly 12 which is adapted to drill a borehole 14 into the Earth 16. The longitudinal axis A-A of the downhole assembly 12 (which corresponds to the longitudinal axis of the torque control device 10) is shown horizontal in FIGS. 1 and 2, but the orientation is unimportant and the present invention can be used with the longitudinal axis at any chosen angle.

The downhole assembly 12 includes a female threaded connector 20 by which the assembly may be connected to a length of drill string (not shown) connected to the surface. Alternatively, the connector 20 can be connected to a downhole motor such as a mud motor, or to a downhole steering tool such as that of EP 1 024 245. It will be understood, however, that the tool can be located uphole of a steering tool if desired.

The connector 20 is connected to an inner shaft 22, which has a through-bore 24 through which drilling fluid can flow to the drill bit 26, in known fashion. In common with prior art downhole assemblies, the drilling fluid passes out through ports (not shown) in the drill bit 26, and then returns to the surface by way of the annulus 30 surrounding the downhole assembly 12 and the drill string.

Though not shown in the drawings, it will be understood that the torque control device 10 will typically include a plurality of blades which engage the borehole 14 and serve to centralise the torque control device 10 within the borehole 14. The downhole assembly may in practice also include a stabiliser located between the torque control device 10 and the drill bit 26, and/or between the connector 20 and the drill string.

The drill bit 26 is connected (in the embodiment of FIGS. 1 and 2 directly, but in other embodiments indirectly) to an outer sleeve 32 which surrounds a part of the inner shaft 22. At least one set of splines 34 interconnect the inner shaft 22 and the outer sleeve 32, so that the inner shaft 22 can slide longitudinally relative to the outer sleeve 32, but cannot rotate relative to the outer sleeve. The number and disposition of the splines will depend upon the torque which is to be transmitted from the inner shaft 22 to the outer sleeve 32.

During normal drilling operations, in the absence of stick-slip, the torque control device 10 is in the condition shown in FIG. 1. Rotation of the drill string (and/or downhole motor) is communicated to the connector 20 and, by way of the inner shaft 22 and splines 34, to the outer sleeve 32 and the drill bit 26.

The through-bore 24 has a port 36 which opens into a valve chamber within the body of a piston 40, the piston 40 comprising an enlargement of the inner shaft 22. An actuating valve 42 is located within the valve chamber of the piston 40, the actuating valve 42 being controlled by a controller 44. The actuating valve 42 controls the passage of drilling fluid from the through-bore 24, through the port 36 and into a cylinder 46. The cylinder 46 has another port 50 which is open to the periphery of the device 10, and therefore to the annulus 30 surrounding the downhole assembly 12.

It will be understood that the pressure of the drilling fluid within the through-bore 24 is substantially higher than the pressure of the drilling fluid within the annulus 30, the difference in pressure being caused primarily by the pressure drop across the drill bit 26. It is arranged that the entry port 36 is of significantly larger area than the exit port 50, so that when the actuating valve 42 is opened drilling fluid flows into the cylinder 46 from the through-bore 24 at a faster rate than fluid can flow out of the cylinder 46 through the port 50.

If the weight on bit is too great for the particular drilling conditions, the rotation of the drill bit 26 will slow relative to the rotation of the connector 20. In the present embodiment this is detected by a strain gauge 52 located upon the shaft 22. It will be understood that the strain gauge 52 is sufficiently sensitive to detect very small angular twisting movements of the inner shaft 22, as caused by small angular deviations of the drill bit 26 relative to the connector 20, which are indicative of the drill bit slowing and the possible onset of stick-slip. The strain gauge 52 detects the strain in the inner shaft 22 and communicates this to the controller 44. The communication is preferably by wires (not shown), but the form of data transmission is not critical to the invention.

The controller 44 has a memory in which is stored a high threshold strain value, and against which the strain measured by the strain gauge 52 is continuously or repeatedly compared. If the comparison is not continuous, it is sufficiently frequent so as quickly to identify unacceptable increases in the measured strain. The high threshold strain value may be determined by calculation or experiment. If the measured strain exceeds the high threshold strain value the controller opens the actuating valve 42 and permits drilling fluid to flow into the cylinder 46.

Figure 2:
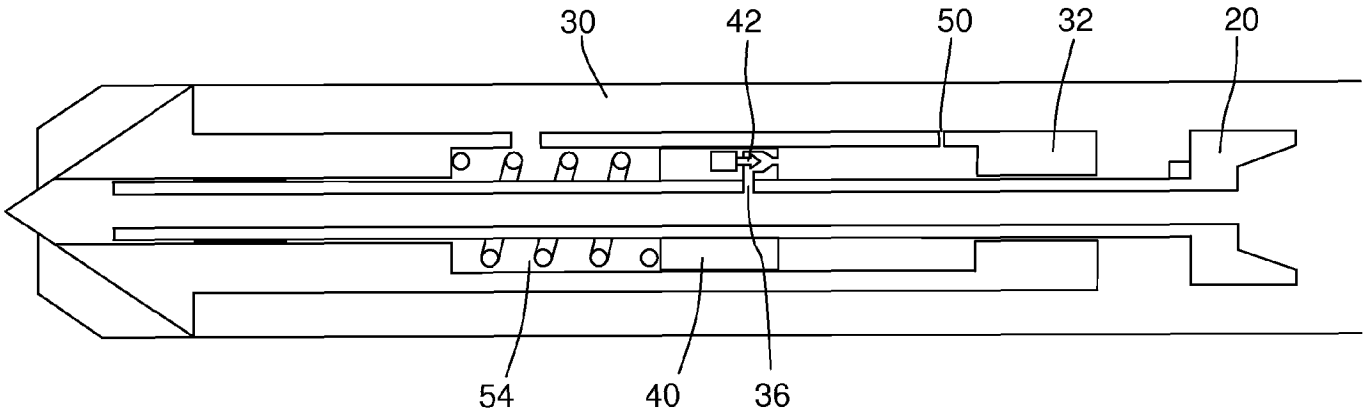
FIG. 2 shows a side view of the tool of FIG. 1, in an actuated condition.

As shown in FIG. 2, when the actuating valve 42 is opened, drilling fluid flows into the cylinder 46 through the entry port 36. Since the flow rate through the entry port 36 and past the valve 42 into the cylinder 46 is greater than the flow rate out of the cylinder through the exit port 50, the volume of the cylinder 46 is thereby caused to increase. The piston 40 is fixed to the inner shaft 22 and does not move relative to the inner shaft 22. Instead, as the volume of the cylinder 46 increases the outer sleeve 32 moves to the right as drawn. This rightwards movement is represented in FIG. 2 by the drill bit 26 being lifted from the bottom of the borehole 14; in practice the actual movement may be very small, but the force with which the drill bit 26 engages the end of the borehole (i.e. the weight on bit) can be reduced significantly.

During this retracting movement of the outer sleeve 32, the connector 20 continues to rotate, and at some point the torque upon the drill bit 26 will exceed the frictional resistance to rotational movement and the drill bit will resume rotation (and will unwind any twist which has been imparted into the drill string).

As the drill bit 26 resumes is rotation, the strain upon the inner shaft 22 will reduce, and will be detected by the strain gauge 52. The memory of the controller 44 also stores a low threshold strain value, the low threshold strain value being a chosen amount lower than the high threshold strain value so as to avoid "hunting". When the low threshold strain value is passed the controller 44 closes the actuating valve 42.

In other embodiments the controller 44 stores only a single threshold strain value, the controller opening the valve 42 when the measured strain rises above that value, and closing the valve 42 when the measured strain falls below that value.

The controller 44 can if desired close the actuating valve 42 to an intermediate position at which the rate of drilling fluid flowing into the cylinder 46 closely matches the rate of fluid flowing out of the cylinder, and it may be arranged to maintain the intermediate position for a predetermined period of time, perhaps a few seconds, so that the device dwells in that operational position (with the volume of the cylinder 46 remaining substantially constant).

When the actuating valve 42 is closed the compression spring 54 acts to drive the drilling fluid out of the cylinder 46, through the exit port 50, so that the tool returns to the condition of FIG. 1. Desirably, the exit port 50 is sufficiently small so that it takes several seconds (e.g. 2-3 seconds) for the device to move from the condition of FIG. 2 to the condition of FIG. 1, it being preferred that the weight on bit be gradually increased back to its desired level rather than suddenly increased.

The drill operator at the surface will be aware that the torque control device 10 has been actuated by virtue of the reduction in pressure of the drilling fluid caused by the opening of the actuating valve 42. The drill operator will typically react by reducing the weight on bit at the surface so as to avoid the onset of stick-slip. The operator can check that the device 10 does not undergo repeated actuation, and if so can steadily increase the weight on bit back to the desired level.

Since the actuation of the torque control device 10 is not dependent upon the force exerted by a spring, the drill operator can set the maximum weight on bit for the drilling conditions. The spring 54 can therefore be made sufficiently strong to exceed the maximum weight on bit which the surface equipment can impart (so that the spring 54 can drive the tool from the condition of FIG. 2 to the condition of FIG. 1 when the actuating valve 42 is closed, regardless of the actual weight on bit. It is not necessary to set the spring force dependent upon the likelihood of stick-slip as in the Tomax and other prior art arrangements.

The drill operator can also adjust the high and low threshold strain values for the actuating valve downhole, without needing to trip the downhole assembly. Specifically, the drill operator at the surface can communicate with the tool 10, and in particular with the controller 44, whilst the tool 10 is downhole. Such communication may be effected by any of the known means for communicating with downhole tools, for example by wire, radio waves, mud pulsing, or RFID units injected into the drilling fluid. Thus, if it is determined that the threshold for actuating the valve 42 is set too low, so that the valve is actuated at strain levels which would not result in damaging stick-slip, the high threshold strain value may be increased without tripping the tool. The drill operator can also switch the torque control device 10 on and off remotely, it perhaps being desirable to switch the torque control device off in certain situations so as to save power.

Figure 4:
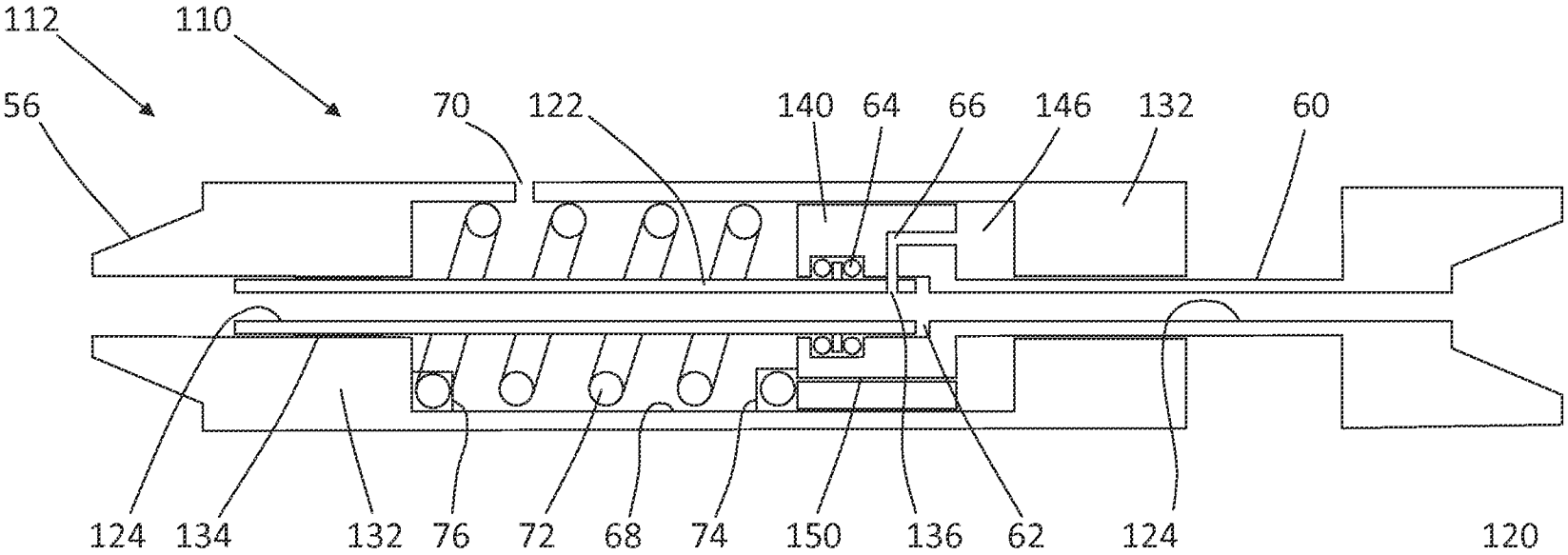
FIG. 4 shows a side view of a tool according to the present improvement.

An alternative embodiment of torque control device 110 is shown in FIG. 4. Though not shown in FIG. 4, the downhole assembly 112 will also include a drill bit (perhaps similar to the drill bit 26 of the embodiment of FIGS. 1 and 2) which is secured by way of a male threaded connector 56. Alternatively, a mud motor for example may be located between the drill bit and the torque control device 110.

The connector 120 is connected to an upper shaft 60, which has a through-bore 124 by which drilling fluid can flow to the drill bit (not shown), in known fashion.

The connector 56 is connected to an outer sleeve 132 which surrounds a lower shaft 122 and part of the upper shaft 60. At least one set of splines 134 interconnects the lower shaft 122 and the outer sleeve 132, so that the lower shaft 122 can slide longitudinally relative to the outer sleeve 132, but cannot rotate relative to the outer sleeve. As with the embodiment of FIGS. 1 and 2, the number and disposition of the splines will depend upon the torque which is to be transmitted from the lower shaft 122 to the outer sleeve 132.

The upper shaft 60 is separate from the lower shaft 122, FIG. 4 showing an exaggerated gap 62 between the facing ends of these shafts. The upper shaft 60 has an enlarged end which forms a piston 140 as described below. A part of the piston 140 surrounds the end of the lower shaft 122, and a set of axial bearings 64 interconnect the piston 140 and the lower shaft 122. The axial bearings 64 permit relative rotation between the piston 140 and the lower shaft 122, but resist relative longitudinal movement. It is therefore arranged that the piston 140 is fixed upon the upper shaft 60, and can rotate relative to the lower shaft 122.

The through-bore 124 within the lower shaft 122 has a port 136 which lies within the region of the lower shaft 122 which is surrounded by the piston 140. The piston has a conduit 66 which can be aligned with the port 136 whereby drilling fluid can pass from the through-bore 124 into a cylinder 146.

The cylinder 146 has an exhaust conduit 150 which in this embodiment passes through the piston 140, and opens into a spring chamber 68. An exhaust port 70 is provided for the spring chamber 68, the exhaust port 70 being open to the periphery of the downhole assembly 112.

It is arranged that the port 136 and conduit 66 are of larger cross-sectional area than the exhaust conduit 150, so that when the conduit 66 is fully aligned with the port 136 drilling fluid flows into the cylinder 146 from the through-bore 124 at a faster rate than fluid can flow out of the cylinder 146 through the conduit 150.

A spring 72 is located within the spring chamber 68. One end of the spring 72 is located in a piston spring pocket 74 and the other end of the spring is located in a sleeve spring pocket 76. The spring 72 acts primarily as a torsion spring, and seeks to rotate the piston 140 relative to the sleeve 132. Since the sleeve 132 is non-rotatably connected to the lower shaft 122 by way of the splines 134, the spring 72 also acts to rotate the piston 140 relative to the lower shaft 122. It is arranged that the spring 72 is biased to move the conduit 66 out of alignment with the port 136.

Thus, in normal operation the conduit 66 is out of alignment (or at least out of full alignment) with the port 136, whereby drilling fluid either cannot flow into the cylinder 146 at all, or at most flows into the cylinder 146 at a rate below that at which it flows out along the conduit 150. The volume of the cylinder 146 is therefore minimised, and the sleeve 132 is extended (to the left as drawn) to its farthest extent relative to the upper shaft 60 and piston 140.

If the weight on bit exceeds the maximum for the drilling conditions, the rate of rotation of the drill bit will reduce. The drill bit is connected to the sleeve 132 so that the rate of rotation of the sleeve, and thereby the lower shaft 122, also reduce. The drill string and therefore the upper shaft 60, however, continue to rotate, so that there is relative rotation between the piston 140 and the lower shaft 122. The conduit 66 and the port 136 will thereby be forced into greater alignment, against the torsional bias of the spring 72, and perhaps into full alignment as shown in FIG. 4. When so aligned, the flow rate of drilling fluid into the cylinder 146 will exceed the flow rate of fluid out of the cylinder 146, so that the volume of the cylinder 146 increases and the sleeve 132 is forced towards the right as viewed, automatically reducing the weight on bit.

As the weight on bit is reduced the rate of rotation of the drill bit increases and the torque within the downhole assembly 110 is reduced. The spring 72 can then rotate the conduit 66 and port 136 out of alignment and the drilling fluid bleeds out of the cylinder 146.

It will therefore be understood that the port 136 and conduit 66 act as a rotary valve to automatically control the volume of the cylinder 146 by allowing drilling fluid (or more drilling fluid) into the cylinder when the rate of rotation of the drill bit drops below that of the drill string.

The spring 72 can determine a threshold value for the torque which will be required to open the rotary valve. It will be understood that the piston 140 needs to rotate through only a few tens of degrees in order to move a totally misaligned conduit 66 and port 136 into full alignment, and the range of relative rotation may be limited by stops (not shown). The torque control device 110 can be assembled with the spring 72 under a chosen pretension, i.e. the spring 72 can in normal conditions bias the piston 140 against a rotational stop.

Whilst the primary function of the spring 72 is to control the rotary valve 66, 136, it also acts as a compression spring and assists the movement of the sleeve 132 (and therefore the drill bit) to the left as drawn as the drilling fluid drains from the cylinder 146. However, unlike the prior art arrangements, the compression force of the spring 72 does not provide the upper limit for the weight on bit.

In the embodiment shown in FIG. 4 the relative rotation of the piston 140 and the lower shaft 122 is directly dependent upon the torque applied to the drill bit by the drill string. In a further modification, a detent mechanism can be provided between the piston 140 and the lower shaft 122, the detent mechanism allowing relative rotation only when a predetermined threshold torque has been exceeded. With such a modification, the opening movement of the rotary valve would be less progressive than the embodiment of FIG. 4.

It will be understood that a small gap is shown between the inner shaft 22 and the outer sleeve 32 in FIGS. 1 and 2, and similarly between the inner shafts 60 and 122 and the outer sleeve 132 in FIG. 4, for the purposes of clarity. In practice, these components would be in sliding engagement, with suitable seals for the cylinder 46, 146 etc.

Figure 3:
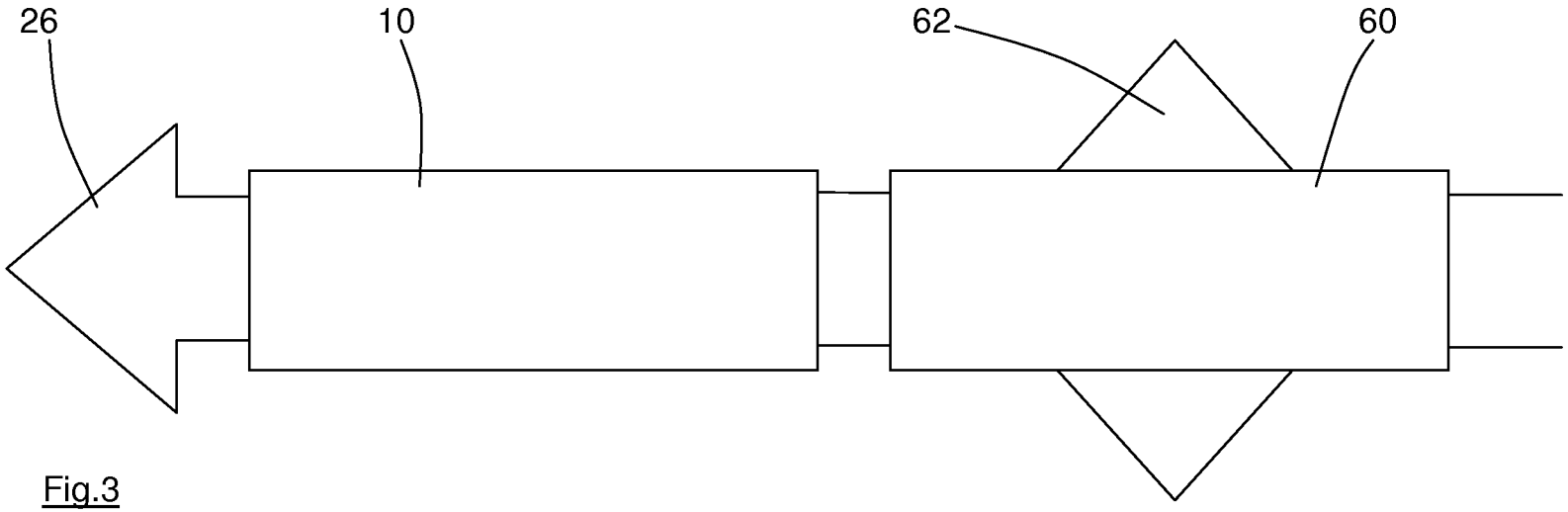
FIG. 3 shows a representation of the tool of the present invention located in a downhole assembly between a reamer and a drill bit.

FIG. 3 represents schematically another useful application of the torque control device 10, 110. In this application, the torque control device 10, 110 is located between the drill bit 26 and a reaming tool 60. In known fashion, the reaming tool 60 includes cutting blades 62 which can be refracted into the body of the tool 60 when not required (during passage through a borehole casing for example) and then actuated to their extended condition as shown at a chosen location downhole. When the cutting blades 62 are extended, the drill bit 26 and the reaming tool 60 are both engaging respective sections of rock. To maximise the rate of advance of the downhole assembly it is desirable to impart a proportion of the torque provided by the drill string to the drill bit 26 and another proportion of the torque to the reaming tool 60, the actual proportions depending on the drilling conditions and the cross-sectional area of rock being removed by the respective components. The tool 10,110 can be used to reduce the torque being imparted to the drill bit 26, and thereby to increase the torque being imparted to the reaming tool 60, the respective proportions being determined by the threshold strain value set for the actuating valve 42 in the embodiment of FIGS. 1 and 2, or that set for the rotary valve 66, 136 in the embodiment of FIG. 4. If the threshold strain value is set correctly, the efficiency of the downhole assembly will be increased, i.e. both the drill bit 26 and the reamer blades 62 will be driven against the respective rock faces with an appropriate force and the advance of the downhole assembly will be maximised.

The torque control device 10,110 is expected to have its greatest utility when used with PDC drill bits, but the invention can be used with other types of drill bit if desired.

What is claimed is:

1. A torque control device for a downhole drilling assembly, the downhole drilling assembly comprising a drill bit and connected componentry which are adapted to rotate during drilling, the torque control device being adapted for connection to the drill bit, the torque control device including an outer sleeve and an inner shaft, the outer sleeve and the inner shaft being respective parts of the connected componentry which are adapted to rotate during drilling, the outer sleeve being movable longitudinally relative to the inner shaft, the torque control device having a cylinder, a piston located within the cylinder, and a controller to adjust the volume of the cylinder, the volume of the cylinder being adjustable whilst the outer sleeve and the inner shaft are rotating.

2. A torque control device according to claim 1 in which the piston is connected to the inner shaft and the cylinder is provided in the outer sleeve.

3. A torque control device according to claim 1 in which changes in the volume of the cylinder cause the outer sleeve to move longitudinally relative to the inner shaft.

4. A torque control device according to claim 1 in which the controller has a memory in which is stored a threshold value, the controller causing the volume of the cylinder to increase when the threshold value is exceeded.

5. A torque control device according to claim 4 in which the threshold value can be adjusted during use.

6. A torque control device according to claim 4 in which the controller is connected to a sensor adapted to determine the torque in a part of the downhole drilling assembly.

7. A torque control device according to claim 4 in which the controller is connected to an accelerometer adapted to determine the rate of rotation of a part of the downhole drilling assembly.

8. A torque control device according to claim 1 in which the cylinder is filled with drilling fluid in use.

9. A torque control device according to claim 8 in which the torque control device has a through-bore for carrying drilling fluid to the drill bit.

10. A torque control device according to claim 9 in which the through-bore is located within the inner shaft.

11. A torque control device according to claim 9 having a fluid entry port between the through-bore and the cylinder, and an actuating valve controlling the flow of drilling fluid through the fluid entry port.

12. A torque control device according to claim 11 in which the cylinder has an exhaust port permitting the flow of drilling fluid out of the cylinder.

13. A torque control device according to claim 1 in which a return spring is provided which acts to reduce the volume of the cylinder.

14. A torque control device according to claim 1 in which the controller is a rotary valve.

15. A torque control device according to claim 14 in which the inner shaft comprises a first part and a second part, the first part of the inner shaft being rotatable relative to the second part of the inner shaft, the piston being connected to the first part of the inner shaft.

16. A torque control device according to claim 15 in which the rotary valve comprises a fluid entry port in the second part of inner shaft and a conduit through the piston, relative rotation of the piston and the second part of the inner shaft varying the overlap between the fluid entry port and the conduit.

17. A torque control device according to claim 16 including a torsion spring which acts to rotate the piston relative to the second part of the inner shaft whereby to reduce the overlap between the fluid entry port and the conduit.

18. A torque control device according to claim 17 in which the torsion spring also acts to reduce the volume of the cylinder.

19. A torque control device according to claim 15 having stops to limit the rotation of the piston relative to the second part of the inner shaft.

20. A torque control device for a downhole drilling assembly, the torque control device being adapted for connection to a drill bit, the torque control device including an outer sleeve and an inner shaft, the outer sleeve being movable longitudinally relative to the inner shaft;

the torque control device having a cylinder, a piston located within the cylinder, and a controller to control the volume of the cylinder, the cylinder being filled with drilling fluid in use;

the torque control device having a through-bore for carrying drilling fluid to the drill bit, a fluid entry port between the through-bore and the cylinder, and an actuating valve controlling the flow of drilling fluid through the fluid entry port, the actuating valve being located within the piston.

21. A torque control device for a downhole drilling assembly, the torque control device being adapted for connection to a drill bit, the torque control device including an outer sleeve and an inner shaft, the outer sleeve being movable longitudinally relative to the inner shaft;

the torque control device having a cylinder, a piston located within the cylinder, and a controller to control the volume of the cylinder, the cylinder being filled with drilling fluid in use;

the torque control device having a through-bore for carrying drilling fluid to the drill bit, a fluid entry port between the through-bore and the cylinder, an actuating valve controlling the flow of drilling fluid through the fluid entry port, and an exhaust port permitting the flow of drilling fluid out of the cylinder, the exhaust port being permanently open, the exhaust port having a smaller cross-sectional area than the fluid entry port.

* * * * *